US005638809A

United States Patent [19]

Wienhold

[11] Patent Number: 5,638,809

[45] Date of Patent: Jun. 17, 1997

[54] COLLAPSIBLE MULTI-LEVEL BAKING RACK ASSEMBLY

[75] Inventor: James L. Wienhold, St. Louis Park, Minn.

[73] Assignee: L & L Products, Inc., West St. Paul, Minn.

[21] Appl. No.: 619,993

[22] Filed: Mar. 21, 1996

[51] Int. Cl.[6] ..... F24C 15/16

[52] U.S. Cl. ..... 126/337 R; 126/332; 126/9 B; 126/9 R; 126/29

[58] Field of Search ..... 126/9 R, 9 B, 126/38, 337 R, 332, 337 A, 333, 29, 30; 108/91

[56] References Cited

U.S. PATENT DOCUMENTS

| | | | |
|---|---|---|---|
| D. 206,549 | 12/1966 | Callender | D44/29 |
| D. 232,340 | 8/1974 | Lax | D7/71 |
| D. 278,196 | 4/1985 | Koves | D6/465 |
| D. 290,970 | 7/1987 | Rich | D18/23 |
| D. 319,356 | 8/1991 | Vukelich, Sr. | D6/405 |
| D. 329,954 | 10/1992 | Sharon et al. | D6/462 |
| D. 334,307 | 3/1993 | Lee | D6/462 |
| D. 334,854 | 4/1993 | Pestone | D6/458 |
| D. 364,288 | 11/1995 | Kramer et al. | D6/465 |
| 1,499,665 | 7/1924 | Kaufman | 126/9 R |
| 2,240,367 | 4/1941 | Fernholtz | 126/9 R X |
| 3,998,170 | 12/1976 | Gordon | 108/91 |
| 4,109,567 | 8/1978 | Gage et al. | 126/30 X |
| 4,191,160 | 3/1980 | Elliott | 126/9 R |
| 4,782,813 | 11/1988 | Kopke | 126/9 R X |

*Primary Examiner*—Larry Jones
*Attorney, Agent, or Firm*—Kinney & Lange, P.A.

[57] ABSTRACT

A collapsible multi-level baking rack assembly includes a plurality of racks, at least one connector leg and at least one leg retainer. Each rack includes at least one horizontally projecting lug. Each connector leg defines a plurality of substantially horizontal, vertically spaced slots for removably receiving a lug of one of the racks to support and space apart the plurality of racks. The retainer leg mutually engages a lug of each rack and the connector leg to retain each lug in each slot of the connector leg.

15 Claims, 1 Drawing Sheet

COLLAPSIBLE MULTI-LEVEL BAKING RACK ASSEMBLY

BACKGROUND OF THE INVENTION

The present invention relates to collapsible multi-level baking, cooking and cooling rack assemblies. In particular, the present invention relates a collapsible multi-level baking rack assembly including a plurality of racks supported and spaced apart from one another by at least one connector leg which releasably engages each rack to permit the plurality of racks to be separated from the connector leg for collapsing the baking rack assembly.

Conventional baking ovens typically include horizontal racks which slide into and mount upon preformed supports along the oven wall. Although as many as three to five spaced apart levels are provided along the oven wall, only two racks are generally provided with the oven. As a result, the baking capacity of the oven is limited. Although additional racks may be purchased from the oven manufacturer, such racks are costly and present storage problems when not in use. In addition, the spacing of conventional oven racks is limited by the spaced apart levels formed as part of the oven wall. Conventional oven racks cannot be used for supporting the baked or cooked foods during cooling outside of the oven.

As a result of the limited baking capacity of conventional ovens, multi-level baking racks configured for being supported by conventional oven racks within the oven have been marketed. The multi-level baking racks typically include two or more racks which are supported and spaced apart from one another by four support legs which are welded to each individual rack. An example of such a rack is illustrated in Kramer et al. U.S. Pat. No. Des. 364,288, assigned to L & L Products, Inc. The multi-level baking rack of U.S. Pat. Des. 364,288 increases an oven's baking capacity when supported by a conventional oven baking rack in the oven. At the same time, the multi-level baking rack may be withdrawn from the oven and used as a cooling rack for cooling the baked or cooked food items. Despite its associated advantages, the multi-level baking rack is not collapsible. As a result, the multi-level baking rack requires a generally large storage area when not being used.

Collapsible cooking assemblies have been proposed for barbecuing and picnicking. However, the proposed collapsible cooking rack assemblies are typically complex and very difficult to assemble and disassemble. In addition, once assembled, the cooking rack assemblies lack sufficient rigidity. As a result, there is a continuing need for a collapsible multi-level baking rack assembly that is simple to assemble and disassemble and that provides sufficient rigidity once assembled.

SUMMARY OF THE INVENTION

The present invention is a collapsible multi-level baking rack assembly. The baking rack assembly includes a plurality of racks, at least one connector leg and at least one leg retainer. Each rack includes at least one horizontally projecting lug. Each connector leg defines a plurality of substantially horizontal, vertically spaced slots for removably receiving a lug of one of the racks to support and space apart the plurality of racks. The retainer leg mutually engages a lug of each rack and the connector leg to retain each lug in each slot of the connector leg. As a result, the multi-level baking-rack is simple and easy to assemble and disassemble for collapsing the baking rack assembly for storage when not in use. Moreover, the collapsible multi-level baking rack assembly of the present invention is rigid once assembled.

In a preferred embodiment of the collapsible multi-level baking rack assembly, each lug comprises an L-shaped member horizontally projecting from a corner of the rack and defines a substantially vertical opening. The leg retainer is an elongate rod having a length sufficient for extending through each opening of each lug between each lug and a connector leg. The retainer leg preferably includes a hooked end for retaining the leg retainer in place.

DETAILED DESCRIPTION OF THE PREFERRED EMBODIMENTS

Figure 1:
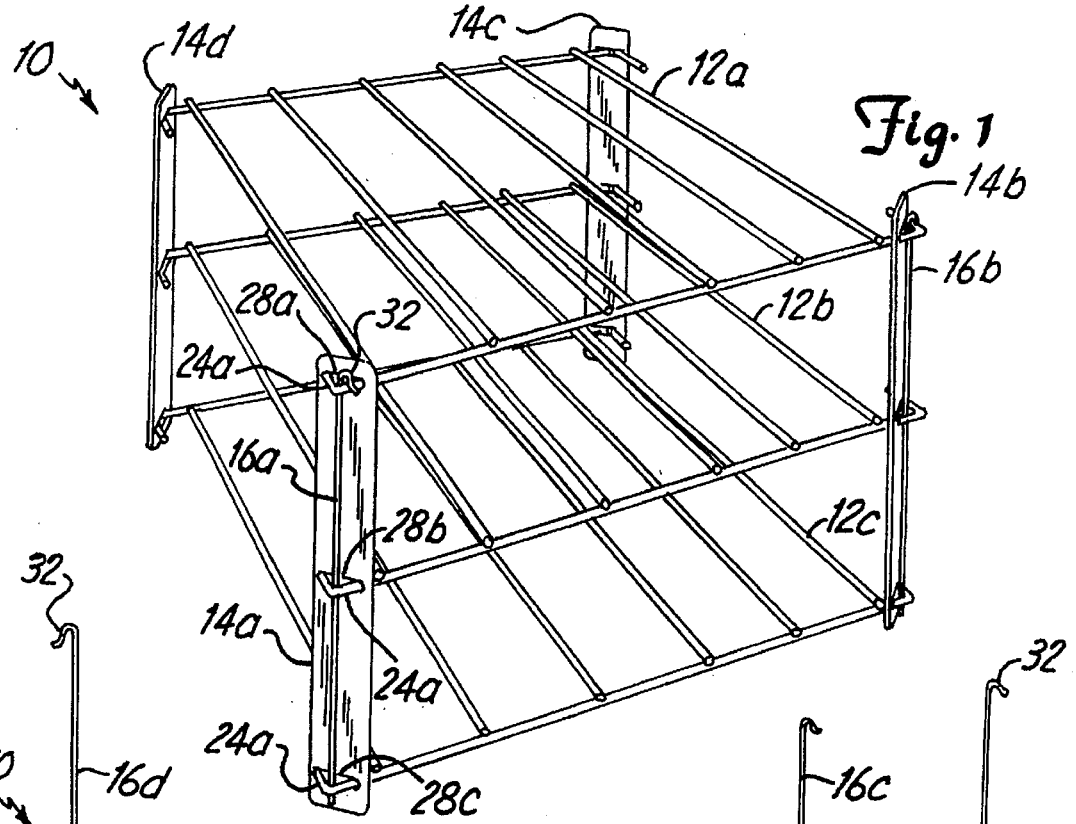
FIG. 1 is a perspective view of a collapsible multi-level baking rack assembly in an assembled state.
Figure 2:
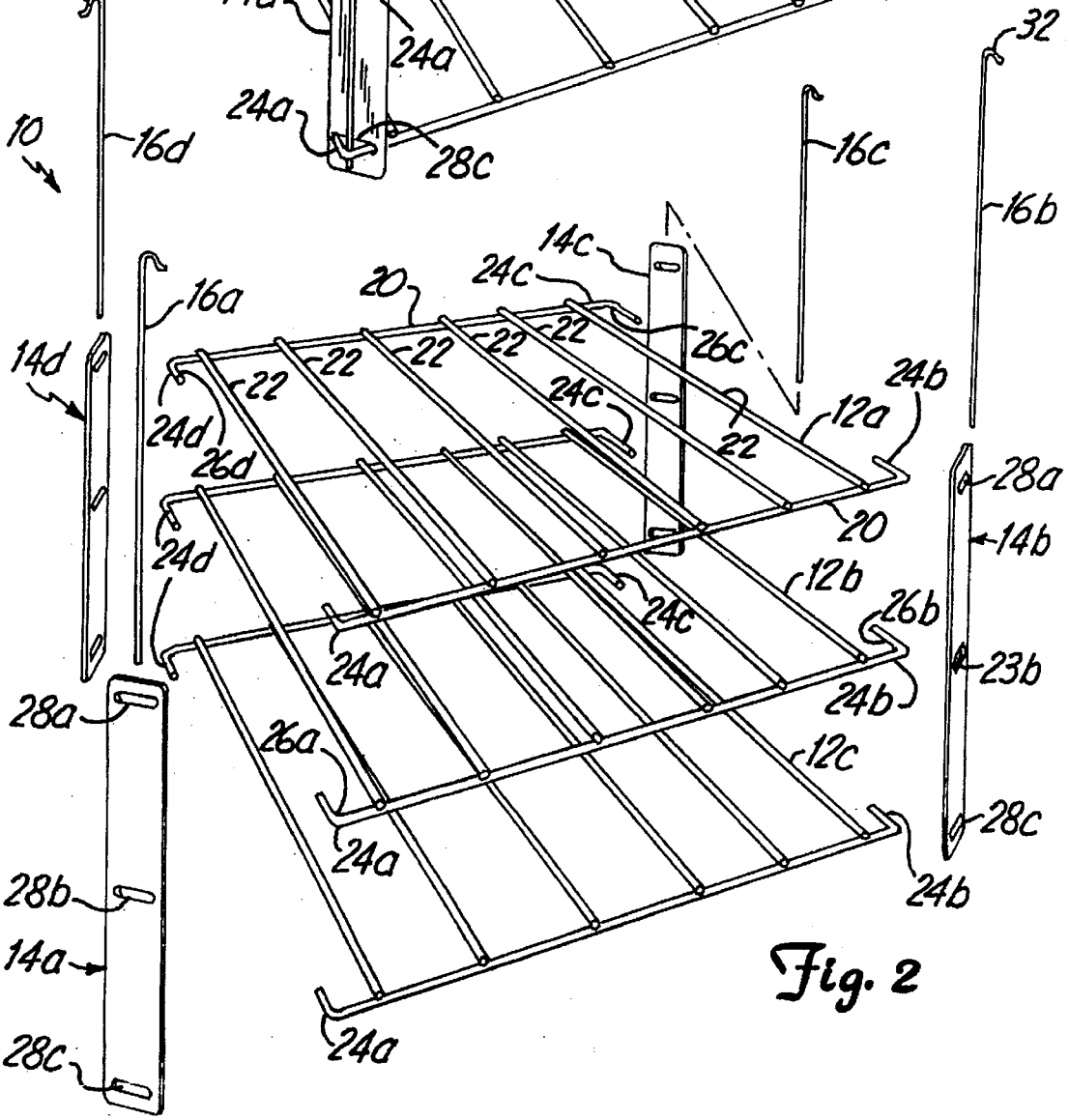
FIG. 2 is an exploded perspective view of the collapsible multi-level baking rack assembly in a disassembled state.

FIGS. 1 and 2 illustrate collapsible multi-level baking rack assembly 10. FIG. 1 is a perspective view illustrating collapsible multi-level baking rack assembly 10 in an assembled state. FIG. 2 is an exploded perspective view illustrating baking rack assembly 10 in a disassembled state to enable baking rack assembly 10 to be collapsed for storage. Baking rack assembly 10 includes baking racks 12*a*–12*c*, connector legs 14*a*–14*d* and leg retainers 16*a*–16*c*. As best shown by FIG. 1, racks 12*a*, 12*b* and 12*c* are horizontally supported and vertically spaced from one another by connector legs 14*a*–14*d*. Leg retainers 16*a*–16*d* mutually engage each rack and each connector leg to retain each rack 12*a*–12*b* in its horizontal position. Removal of leg retainers 16*a*–16*b* permits connector legs 14*a*–14*c* to be easily separated from racks 12*a*–12*c*, thereby allowing baking rack assembly 10 to be easily disassembled and collapsed for storage.

As best shown by FIG. 2, racks 12*a*–12*c* each include a pair of opposing and spaced apart rack ends 20 and a plurality of rack tie rods 22. Rack tie rods 22 are generally elongate rods or bars which have ends that are fixedly coupled, preferably by welding, to the opposing rack ends 20 to form a substantially flat, horizontal rack. Rack tie rods 22 are preferably spaced apart from one another along rack ends 20 by a distance of about 2.96 inches. Tie rods 22 are preferably made from nine gauge 1018 CRS wire with a nickel-chrome finish. Tie rods 22 preferably have a flatness across of about 0.010 inches. Tie rods 22 preferably have a length of about 14.00 inches.

Rack ends 20 are elongated wires or bars spaced apart from one another on opposite ends of rack tie rods 22. Each rack end 20 has ends which are bent inwardly towards an opposite rack end to form lugs 24*a*–24*d* of each rack 12. Each lug 24 extends generally horizontally with respect to rack ends 20 and rack tie rods 22. Lugs 26*a*–26*d* engage connector legs 14*a*–14*d*, respectively, to space apart and rigidly support racks 12*a*–12*c* with respect to one another. Rack ends 20 are preferably made from eight gauge 1018 CRS wire with a nickel-chrome finish. Rack ends 20 preferably have a flatness across of about 0.010 inches. Rack ends 20 preferably have an overall length of about 18.9 inches. Each of the inwardly bent ends preferably has a length of about 0.91 inches. Accordingly, each rack end has a length between the corners of about 17.15 inches.

In the preferred embodiment illustrated, each lug 24 is formed by bending ends of rack ends 20 at a substantially 90° angle to form generally L-shaped corners on each rack 12. Lugs 24 define substantially vertical openings 26 sized for receiving leg retainers 16. In the preferred embodiment illustrated, openings 26*a* are defined along an inner concave surface of each horizontal lug 24. Alternatively, openings 26*a* may be formed by extending the ends of rack ends 20 to form loops or by forming vertical holes through generally flat surfaces of lugs which are fixedly connected along a perimeter of rack 12. Because lugs 24*a*–24*d* extend beyond an adjacent tie rod 22, each of racks 12*a*–12*c* provides a more useful area for supporting baking and cooking containers. As can be appreciated, lugs 24*a*–24*d* may have a variety of different shapes, configurations and locations. For example, lugs 24 may alternatively comprise flat tabs or projections which define holes and which are fixedly coupled anywhere along a perimeter of rack 12. Furthermore, lugs 24 may alternatively be formed from L-shaped corners formed at the junction of rack ends 20 and rack tie rods 22.

Connector legs 14*a*–14*d* are generally elongate flat plates or bars which define slots 28*a*–28*c*. Slots 28*a*–28*c* extend through each connector leg 14 and are spaced apart from one another along each connector leg 14 by the distance at which racks 12*a*–12*c* are to be spaced apart from one another upon assembly of rack assembly 10. Each slot 28*a*–28*c* is substantially horizontal and is sized for receiving a corresponding lug 24 of racks 12*a*–12*c*. The length of slots 28*a*–28*c* define the extent to which lugs 24*a*–24*d* extend through slots 28*a*–28*c*. Slots 28*a*–28*c* permit openings 26 of each lug 24 to extend through connector leg 14. In the preferred embodiment, each slot 28*a*–28*c* has a length of about 0.840 inches and a width of about 0.165 inches. Slots 28*a*–28*c* are preferably spaced from one another by about 3.05 inches. Each connector leg 14 is preferably made from a 24 gauge strip of 1018 CRS material with a nickel-chrome finish. Each connector leg 14 preferably has a length of about 6.10 inches and a width of about 1.08 inches.

Leg retainers 16*a*–16*d* are generally elongated rods having a length of at least equal to or greater than the spacing between slots 28*d* and 28*c* to enable each leg retainer 16 to maintain a corresponding connector leg 14 in engagement with racks 12*a*–12*c*. Each leg retainer 16 has a hooked end 32 for engaging rack 12*a* to maintain the leg retainer 16 in position. Each leg retainer 16 preferably has a cross-sectional area less than or equal to the size of openings 26 to enable leg retainer 16 to be slidably inserted through openings 26. In the preferred embodiment illustrated, leg retainers 16*a*–16*d* have a length of about 5.90 inches and a diameter of about 0.095 inches (33 gauge music wire). Each leg retainer is preferably coated with a nickel-chrome finish. Hooked end 32 is preferably bent outwardly at an angle of about 30 degrees with respect to the vertical.

As best shown by FIG. 1, upon assembly of collapsible baking rack assembly 10, lugs 24*a*–24*d* of each rack 12*a*–12*c* slidably fit within corresponding slots 28*a*–28*c* of connector legs 14*a*–14*d*, respectively. Lugs 24 engage the top surface, the bottom surface and both side surfaces of each slot 28 extending through connector legs 14*a*–14*d*. As a result, racks 12*a*–12*d* are rigidly supported and spaced apart from one another.

To rigidly maintain baking rack assembly 10 in an assembled state, openings 26*a* of each rack 12*a*–12*c* extend through slots 28 and are vertically aligned with one another for receiving leg retainer 16*a*. Leg retainer 16*a* extends through each aligned opening 26*a* adjacent the inner concave surface of each lug 24*a* of racks 12*a*–12*c* between the L-shaped corner forming each lug 24*a* and connector leg 14*a* to capture lugs 24*a* of racks 12*a*–12*c* within slots 28*a*–28*c* of connector leg 14*a*. Hook 32 extends over and partially around lug 24*a* of rack 12*a* to maintain leg retainer 16*a* in place. The remaining connector legs 14*b*–14*d* are retained in engagement with racks 12*a*–12*c* in a similar fashion by leg retainers 16*b*–16*d*, respectively. As a result, racks 12*a*–12*c* are rigidly supported and spaced apart from one another.

In the preferred embodiment illustrated, baking rack assembly 10 has a length of about 16.75 inches, a width of about 14.00 inches and a height of about 6.10 inches. Each rack 12*a*–12*c* is spaced from an adjacent rack by about 2.50 inches. As a result, baking rack assembly 10 is sized for easy insertion into conventional ovens and may be easily supported by existing oven racks to increase the baking and cooking capacity of the oven. Baking rack assembly 10 may also be easily removed from the oven for use as a cooling rack.

To assemble baking rack assembly 10, the user simply positions each lug 24 through a corresponding slot in a connector leg. Once the lugs 24 of each rack are inserted through a slot in each of the four connector legs, leg retainers 16*a*–16*d* are simply inserted through aligned openings 26*a*–26*d* of lugs 24*a*–24*d* to releasably lock the assembly in place. Thus, baking rack assembly may be easily assembled. At the same time, disassembly of baking rack assembly 10 for storage merely requires one to withdraw leg retainers 16*a*–16*c* from aligned openings 26*a*–26*d* which enables connector legs 14*a*–14*d* to be separated from racks 12*a*–12*c*. As a result, rack assembly 10 may be easily disassembled for compact storage.

Collapsible baking rack assembly 10 provides a simple collapsible inexpensive baking rack assembly for increasing an oven's baking or cooking capacity and also for providing a cooling rack once removed from the oven. Due to its simple construction, baking rack assembly 10 is simple and easily manufactured in less time and at a lower cost. Also owing to its simplicity, baking rack assembly 10 may be easily assembled or collapsed by inserting or removing leg retainers 16. Although easy to assemble and collapse, baking rack assembly 10 is also sturdy and rigid. Because connector legs 14*a*–14*d* engage top, bottom and side surfaces of lugs 24 and because leg retainers 16*a*–16*d* snugly secure connector legs 14*a*–14*d* in engagement with lugs 24*a*–24*d* of each rack 12*a*–12*c*, baking rack assembly 10 is less prone to vibration and other undesirable characteristics.

As can be appreciated, the number of connector legs and leg retainers for supporting and spacing apart racks 12*a*–12*c* may be greater or less than four. In addition, the number of racks 12, the number of slots 28 in each connector leg 14 and the spacing between racks 12 and slots 28 may be increased or decreased as desired.

Although the present invention has been described with reference to preferred embodiments, workers skilled in the art will recognize that changes may be made in form and detail without departing from the spirit and scope of the invention.

What is claimed is:

1. A collapsible multi-level baking rack assembly comprising:

a plurality of racks, each rack including at least one horizontally projecting lug;

at least one connector leg defining a plurality of substantially horizontal, vertically spaced slots, each slot removably receiving a lug of one of the racks to support and space apart the plurality of racks; and at least one leg retainer removably engaging both a portion of the lug of each rack and the connector leg to retain each lug in each corresponding slot of the connector leg.

2. The rack assembly of claim 1 wherein each lug comprises an L-shaped member having a corner horizontally projecting from a corner of rack, and wherein the corner of each L-shaped member is removably received within the slot.

3. The rack assembly of claim 2 wherein the leg retainer is slidably received between the corner of the L-shaped member and the connector leg.

4. The rack assembly of claim 1 wherein each lug defines a substantially vertical opening and wherein the leg retainer includes:

an elongate rod having a length sufficient for extending through each opening of each lug between each lug and the connector leg.

5. The rack assembly of claim 4 wherein the elongate rod includes a hooked end for retaining the leg retainer in place.

6. The rack assembly of claim 1 wherein a portion of each of the lugs removably extends through the corresponding slot of the connector leg, and wherein the leg retainer removably engages the portion of the lug extending through the slot.

7. The rack assembly of claim 1 wherein each rack comprises:

spaced apart rack ends, each rack end being an elongate wire having inwardly bent ends forming corners of the rack; and a plurality of tie rods extending between and fixedly coupled to the spaced apart rack ends.

8. The rack assembly of claim 1 further comprising:

a plurality of connector legs, and a plurality of leg retainers.

9. The rack assembly of claim 1, wherein each of the racks provides a generally horizontal surface which is accessible from at least one side.

10. The rack assembly of claim 1 wherein the connector leg is provided by an elongate flat plate, and wherein the slots are holes through the elongate flat plate.

11. A collapsible multi-level baking rack assembly comprising:

a plurality of racks, each rack including:

a pair of spaced apart rack ends, each rack end including an elongated wire having ends inwardly bent to form L-shaped corners of the rack; and a plurality of rack tie rods fixedly coupled to and extending across the pair of rack ends;

a plurality of connector legs for supporting and spacing apart the plurality of racks, each connector leg including a plurality of spaced apart slots corresponding to the plurality of racks, each slot being sized for slidably receiving one of the L-shaped corners of the racks, wherein corresponding L-shaped corners of the racks extend through a corresponding connector leg and are aligned with one another to define plurality of aligned openings between the corresponding L-shaped corners and the corresponding connector leg; and a plurality of leg retainers, each leg retainer comprising an elongated rod having a hook end, wherein insertion of the elongate rod through each of the plurality of aligned openings between the L-shaped corners and the connector leg retains each of the plurality of racks in engagement with the connector leg and wherein removal of the leg retainer permits the plurality of racks to be separated from the connector leg to collapse the baking rack assembly.

12. The rack assembly of claim 11 wherein each connector leg is provided by an elongate flat plate, and wherein the slots are holes through the elongate flat plate.

13. A collapsible multi-level baking rack assembly comprising:

a plurality of baking racks, each baking rack including:

spaced apart rack ends, each rack end being an elongate wire having inwardly bent ends forming corners of the rack; and a plurality of tie rods extending between and fixedly coupled to the spaced apart rack ends;

a plurality of connector legs, each connector leg including a plurality of vertically spaced apart slots sized for receiving a corner of one of the plurality of racks, wherein the connector leg receives and aligns corresponding corners of the rack to support and space apart the plurality of racks; and a plurality of leg retainers slidably received between the corner of each rack and the connector leg, wherein insertion of each leg retainer retains corresponding corners of the plurality of racks within the slots of a corresponding connector leg and wherein removal of leg retainers permits the plurality of racks and the plurality of connector legs to be disassembled for storage.

14. The rack assembly of claim 13 wherein the leg retainer includes a hook releasably engaging one of the plurality of racks to maintain the leg retainer in position.

15. The rack assembly of claim 13 wherein each connector leg is provided by an elongate flat plate, and wherein the slots are holes through the elongate flat plate.

* * * * *